US009370262B2

(12) United States Patent
Wirth

(10) Patent No.: US 9,370,262 B2
(45) Date of Patent: Jun. 21, 2016

(54) OPEN REFRIGERATED DISPLAY CASE AND A FLOW STABILIZING DEVICE

(71) Applicant: Wirth Research Limited, Bicester Oxfordshire (GB)

(72) Inventor: Nicholas J. P. Wirth, Northamptonshire (GB)

(73) Assignee: Wirth Research Limited, Bicester Oxfordshire (GB)

( * ) Notice: Subject to any disclaimer, the term of this patent is extended or adjusted under 35 U.S.C. 154(b) by 0 days.

(21) Appl. No.: 14/840,727

(22) Filed: Aug. 31, 2015

(65) Prior Publication Data

US 2015/0374142 A1 Dec. 31, 2015

Related U.S. Application Data

(63) Continuation of application No. 14/702,249, filed on May 1, 2015.

(30) Foreign Application Priority Data

Jun. 27, 2014 (GB) ..... 1411474.8
Feb. 10, 2015 (GB) ..... 1502192.6

(51) Int. Cl.
*F24F 9/00* (2006.01)
*A47F 3/04* (2006.01)

(52) U.S. Cl.
CPC ..... *A47F 3/0447* (2013.01); *A47F 3/0469* (2013.01); *A47F 2003/046* (2013.01)

(58) Field of Classification Search
CPC ..... A47F 3/0447; A47F 3/0452; A47F 2003/046; F25D 17/045
USPC ..... 454/190–193; 62/251
See application file for complete search history.

(56) References Cited

U.S. PATENT DOCUMENTS 2,822,672 A * 2/1958 Dickson ..... A47F 3/0447 62/125
3,063,253 A * 11/1962 Dickson ..... A47F 3/0447 219/201

(Continued)

FOREIGN PATENT DOCUMENTS

EP 1508288 2/2005
EP 1508288 * 7/2013 ..... A47F 3/0447

(Continued)

OTHER PUBLICATIONS

International Search Report for PCT/GB2015/051891 dated Sep. 9, 2015.

(Continued)

*Primary Examiner* — Alissa Tompkins
*Assistant Examiner* — Frances F Hamilton
(74) *Attorney, Agent, or Firm* — Honigman Miller Schwartz and Cohn LLP

(57) ABSTRACT

An open refrigerated display case comprising: a refrigerated display area comprising one or more shelves; an air outlet and an air inlet opening into the display area and spaced from one another; a duct fluidically coupling the air inlet to the air outlet, the duct being configured to direct air flow out of the air outlet across the display area and toward the air inlet to form an air curtain across the display area; wherein each of the one or more shelves are provided with an associated flow stabilizing device; wherein each flow stabilizing device comprises a pair of stabilizing beams which are spaced from one another so as to define an innermost stabilizing beam and an outermost stabilizing beam; wherein a first slot is formed between the innermost and the outermost stabilizing beams, the first slot extending transversely across the display area perpendicular to the direction of the air flow within the air curtain, the first slot having a stabilizing inlet, a stabilizing outlet and a stabilizing throat disposed therebetween; wherein the innermost stabilizing beam is spaced from the adjacent shelf so as to form a second slot between the innermost stabilizing beam and the shelf; and wherein the one or more flow stabilizing devices are each positioned so that the stabilizing inlet of the first slot receives the air curtain, the stabilizing throat being configured to stabilize the air flow within the air curtain which exits the flow stabilizing device via the stabilizing outlet.

27 Claims, 4 Drawing Sheets

(56) References Cited

U.S. PATENT DOCUMENTS

| | | | | | |
|---|---|---|---|---|---|
| 3,063,256 | A * | 11/1962 | Lamb | A47F 3/0447 | 454/193 |
| 3,229,475 | A * | 1/1966 | Balk | A47F 3/0447 | 62/246 |
| 3,233,423 | A * | 2/1966 | Beckwith | A47F 3/0447 | 454/193 |
| 3,768,394 | A * | 10/1973 | Powlesland | F24F 13/26 | 239/419.5 |
| 4,807,446 | A * | 2/1989 | Sunaga | A47F 3/0469 | 62/256 |
| 6,742,344 | B2 * | 6/2004 | Vormedal | A47F 3/0447 | 454/193 |
| 6,874,331 | B2 * | 4/2005 | Chandler | A47F 3/0447 | 454/193 |
| 7,797,959 | B2 * | 9/2010 | Amari | A47F 3/0447 | 62/256 |
| 8,729,429 | B2 * | 5/2014 | Nuttall | A47F 3/001 | 219/214 |
| 8,794,021 | B2 * | 8/2014 | Hahn | A47F 3/0447 | 62/255 |
| 2001/0003702 | A1 * | 6/2001 | Livchak | A47F 3/0447 | 454/193 |
| 2002/0162347 | A1 * | 11/2002 | Walker | A47F 3/0447 | 62/256 |
| 2004/0069002 | A1 * | 4/2004 | Chuang | A47F 3/0447 | 62/256 |
| 2005/0217297 | A1 | 10/2005 | Wilson | | |
| 2007/0251253 | A1 | 11/2007 | Alahyari et al. | | |
| 2008/0236182 | A1 * | 10/2008 | Hahn | A47F 3/0447 | 62/256 |
| 2011/0302945 | A1 * | 12/2011 | Howington | A47F 3/0447 | 62/256 |

FOREIGN PATENT DOCUMENTS

| | | | | |
|---|---|---|---|---|
| FR | 2690825 | * | 11/1993 | A47F 3/0447 |
| FR | 2690825 | A1 | 11/1993 | |
| GB | 2522571 | * | 7/2015 | A47F 3/0447 |
| JP | S51150569 | A | 12/1976 | |
| JP | S55165468 | A | 12/1980 | |
| JP | S5758884 | A | 4/1982 | |
| JP | S58110977 | A | 7/1983 | |
| JP | S59174588 | A | 10/1984 | |
| JP | S61196661 | A | 8/1986 | |
| JP | S62162569 | A | 7/1987 | |
| JP | 2010207564 | A | 9/2010 | |
| JP | 2010207564 | A * | 9/2010 | |
| JP | 2011104081 | A | 6/2011 | |
| JP | 2011131036 | A * | 7/2011 | |
| JP | 2011131036 | A | 7/2011 | |
| JP | 2011167384 | A | 9/2011 | |
| JP | 2011188889 | A | 9/2011 | |
| JP | 2012161409 | A | 8/2012 | |
| JP | 2014108180 | A * | 6/2014 | |
| JP | 2014108180 | A | 6/2014 | |

OTHER PUBLICATIONS

UK Search Report for Application GB1411474.8 dated Oct. 29, 2014.
UK Search Report for Application GB1504704.6 dated May 22, 2015.
UK Search Report for Application GB1502192.6 dated May 22, 2015.
European Search Report for Application EP15162947 dated Sep. 17, 2015.
European Examination Report for Application EP15162947.4 dated Jan. 27, 2016.
UK Examination Report for Application GB1502192.6 dated Mar. 15, 2016.

* cited by examiner

OPEN REFRIGERATED DISPLAY CASE AND A FLOW STABILIZING DEVICE

CROSS-REFERENCE TO RELATED APPLICATIONS

The present application is a continuation application of U.S. Ser. No. 14/702,249 filed May 1, 2015 which claims priority to UK Application No. 1502192.6 filed on 10 Feb. 2015 and UK Application No. 1411474.8 filed on 27 Jun. 2014, which are hereby incorporated by reference in their entirety for any and all purposes.

BACKGROUND

The invention relates to an open refrigerated display case and a flow stabilizing device for an open refrigerated display case.

The display of chilled or frozen items is commonplace in many retail environments, most notably in supermarkets. Conventionally, such items have been displayed in refrigerated display cases having glass doors to allow customers to browse items before opening the doors to access the items. However, the presence of such doors has been seen as problematic in that they make it difficult for several customers to access the contents of the case, as well as providing an obstruction when open, narrowing the usable aisle space.

It is therefore common for supermarkets to use open-fronted display cases (Open Refrigerated Display Cases; herein "ORDCs"). ORDCs utilize an air curtain which is cooled to below ambient temperature and propelled downward, across the open front of the display case. The air curtain separates the refrigerated interior of the display case from the ambient air surrounding the display case. The air curtain thus keeps the cool air inside the display case from spilling out due to buoyancy effects, and also provides a barrier from other external motions of air around the display case. ORDCs therefore do not need any physical barrier separating customers from the contents of the display case. Accordingly, ORDCs provide a desirable method of displaying food and other perishable goods as they allow both easy access and clear visibility of merchandise.

However, as a direct consequence of their open design, ORDCs do have significantly higher energy consumption compared to the closed-fronted alternative. The main energy losses occur within the air curtain, and are caused by the entrainment of warm ambient air into the air curtain and the turbulent mixing which occurs within the air curtain itself. The entrainment of warm ambient air causes an increase in temperature within the air curtain, and this warmer air must be cooled as it re-circulates through the system. It has been estimated that 70% to 80% of the cooling load of an ORDC is due to such effects.

In recent years, multi-decked designs have become commonplace to maximize the display space per unit of floor space. Consequently, the air curtains of such ORDCs must seal a larger display area. This has exacerbated entrainment issues and the resulting energy losses, as well as making the design of air curtains more challenging, particularly in respect of ensuring product integrity and temperature homogeneity while attempting to minimize their energy consumption.

The invention thus seeks to improve the efficiency of ORDCs by reducing entrainment within the air curtain.

SUMMARY

According to an aspect of the invention there is therefore provided an open refrigerated display case comprising: a refrigerated display area comprising one or more shelves; an air outlet and an air inlet opening into the display area and spaced from one another; a duct fluidically coupling the air inlet to the air outlet, the duct being configured to direct air flow out of the air outlet across the display area and toward the air inlet to form an air curtain across the display area; wherein each of the one or more shelves are provided with an associated flow stabilizing device disposed; wherein each flow stabilizing device comprises a pair of stabilizing beams which are spaced from one another so as to define an innermost stabilizing beam and an outermost stabilizing beam; wherein a first slot is formed between the innermost and the outermost stabilizing beams, the first slot extending transversely across the display area perpendicular to the direction of the air flow within the air curtain, the first slot having a stabilizing inlet, a stabilizing outlet and a stabilizing throat disposed therebetween; wherein the innermost stabilizing beam is spaced from the adjacent shelf so as to form a second slot between the innermost stabilizing beam and the shelf; and wherein the one or more flow stabilizing devices are each positioned so that the stabilizing inlet of the first slot receives the air curtain, the stabilizing throat being configured to stabilize the air flow within the air curtain which exits the flow stabilizing device via the stabilizing outlet.

The stabilizing inlet may be wider than the stabilizing outlet and the stabilizing throat may converge from the stabilizing inlet to the stabilizing outlet.

The stabilizing throat may converge at greater than 0° and less than 20°.

The flow stabilizing devices may be spaced from the air outlet and/or one another by a distance which corresponds to approximately 4 to 6 times a width of the air outlet.

The flow stabilizing devices may be spaced by a distance which corresponds to approximately 5 times a width of the air outlet.

Each flow stabilizing device may be connected to the one or more shelves.

Each flow stabilizing device may be pivotably connected to the one or more shelves.

Each flow stabilizing device may be configured so as to allow a distance between the shelf and the stabilizing inlet of the first slot to be varied.

The flow stabilizing device may further comprise a pair of arms which connect the stabilizing beams to the open refrigerated display case.

The stabilizing beams may be transparent.

The outermost stabilizing beam may be provided with a product information strip.

The open refrigerated display case may further comprise an injector port which is configured to introduce additional air into the air curtain.

The injector port may be connected to the duct.

According to another aspect of the invention there is therefore provided a flow stabilizing device for stabilizing an air curtain of an open refrigerated display case, the flow stabilizing device comprising: a pair of stabilizing beams which are spaced from one another so as to define an innermost stabilizing beam and an outermost stabilizing beam; wherein a first slot is formed between the innermost and the outmost stabilizing beams, the first slot having a stabilizing inlet, a stabilizing outlet and a stabilizing throat disposed therebetween; wherein the flow stabilizing device is configured to be positioned so that: a second slot is formed between the innermost stabilizing beam and an adjacent shelf of the open refrigerated display case; and the stabilizing inlet of the first slot receives the air curtain, the stabilizing throat being configured to stabilize the air flow within the air curtain which exits the flow stabilizing device via the stabilizing outlet.

The stabilizing inlet may be wider than the stabilizing outlet and the stabilizing throat may converge from the stabilizing inlet to the stabilizing outlet.

The stabilizing throat may converge at greater than 0° and less than 20°.

The flow stabilizing device may be configured to be connected to a shelf of the open refrigerated display case.

The flow stabilizing device may be configured to be pivotably connected to the shelf.

The flow stabilizing device may be configured so as to allow a distance between the shelf and the stabilizing inlet to be varied.

The flow stabilizing device may further comprise a pair of arms which are configured to connect the stabilizing beams to the open refrigerated display case.

The stabilizing beams may be transparent.

The outermost stabilizing beam may be provided with a product information strip.

The flow stabilizing device may further comprise an injector port which is configured to introduce additional air into the air curtain.

BRIEF DESCRIPTION OF THE DRAWINGS

For a better understanding of the invention, and to show more clearly how it may be carried into effect, reference will now be made, by way of example, to the accompanying drawings, in which.

DETAILED DESCRIPTION

Figure 1:
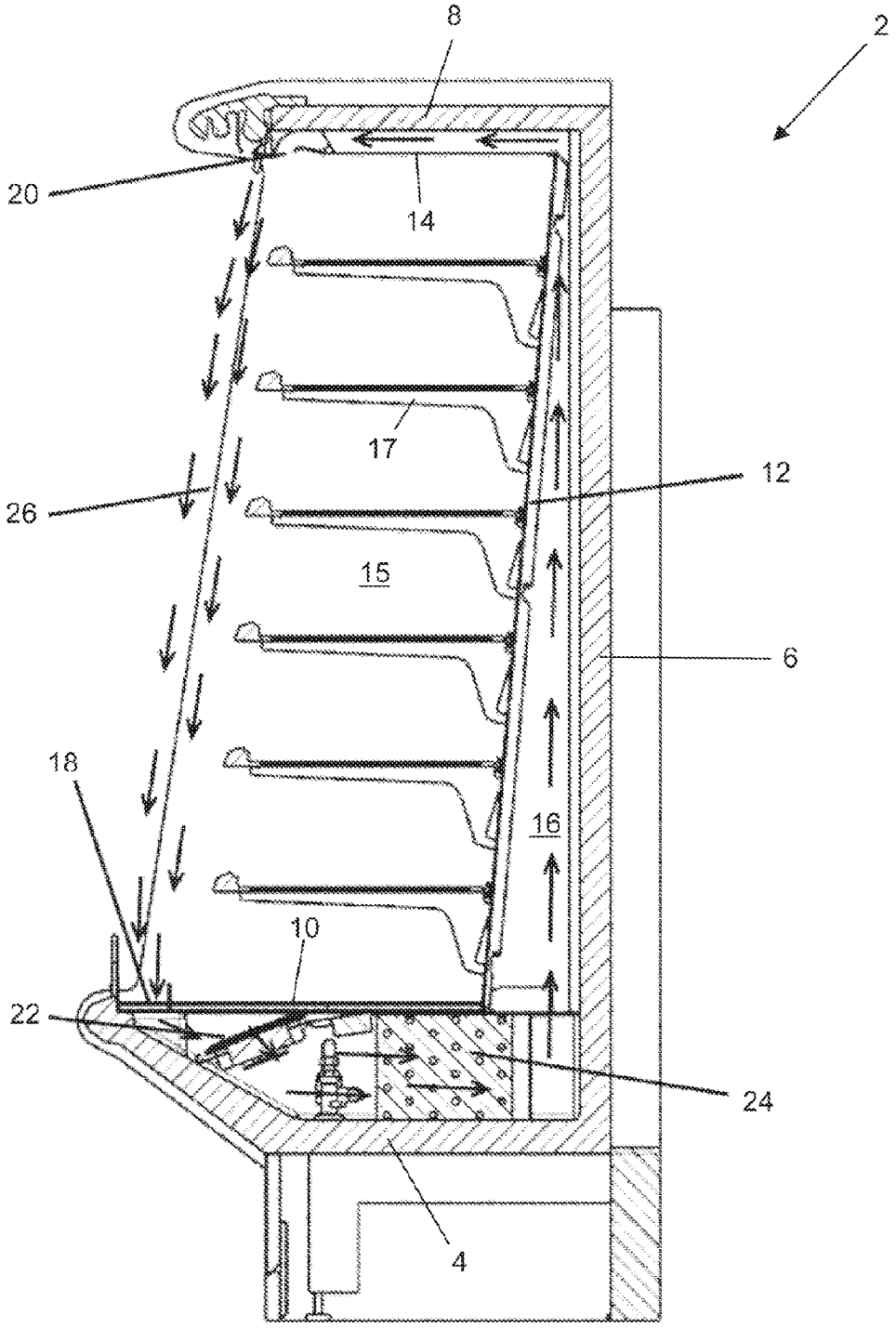
FIG. 1 (PRIOR ART)
FIG. 1 is a side cross-sectional view of a conventional open refrigerated display case (ORDC)

FIG. 1 shows a conventional ORDC 2. The ORDC 2 comprises a cabinet portion formed by a lower wall 4, a back wall 6, an upper wall 8, and left and right side walls (not shown). A lower panel 10, a back panel 12 and an upper panel 14 are disposed within the cabinet portion.

The lower, back and upper panels 10, 12, 14 form a display area 15 which is provided with a plurality of shelves 17 (six are shown) on which items may be displayed. The shelves 17 are affixed to the back panel 12.

As shown, the lower, back and upper panels 10, 12, 14 are spaced from the respective lower, back and upper walls 4, 6, 8 to form a duct 16. An intake grille 18 is provided at the lower panel 10 to form an inlet to the duct 16. Similarly, a discharge grille 20 is provided at the upper panel 14 to form an outlet from the duct 16. The intake grille 18 and the discharge grille 20 are thus fluidically coupled to one another by the duct 16. The intake grille 18 and the discharge grille 20 are spaced from the back panel 12 toward the front of the cabinet portion and ahead of the shelves 17.

A fan 22 and a heat exchanger 24 are located within the duct 16 adjacent to the intake grille 18 and thus are disposed between the lower wall 4 and the lower panel 10. The fan 22 draws air into the duct 16 via the intake grille 18 which then passes through the heat exchanger 24 where it is cooled to well below the ambient temperature.

After passing through the heat exchanger 24, the air continues through the duct 16 between the back wall 6 and the back panel 12. The back panel 12 is perforated allowing air to pass from the duct 16 into the display area 15 where it cools items located on the shelves 17 and on the lower panel 10.

The remaining air flows through the duct 16 to the discharge grille 20. The air is ejected from the discharge grille 20 and descends over the open front of the display area 15 to form an air curtain 26. The air curtain 26 passes from the discharge grille 20 to the intake grille 18, where it is drawn in by the fan 22 and re-circulated through the duct 16. The air curtain 26 thus forms a non-physical barrier which separates the display area 15 from the ambient air surrounding the ORDC 2.

As shown in FIG. 1, the air curtain 26 may be angled away from vertical by around 5-10°. This may be achieved by angling the discharge grille 20. In particular, the discharge grille 20 may be provided with a honeycomb panel (not shown) which rectifies the air flow as it exits the discharge grille 20 to provide laminar flow. The air curtain 26 may also deviate away from the back panel 12 as a result of the air passing through the perforations in the back panel 12. The intake grille 18 is therefore offset from the discharge grille 20 to allow for this.

Figure 2:
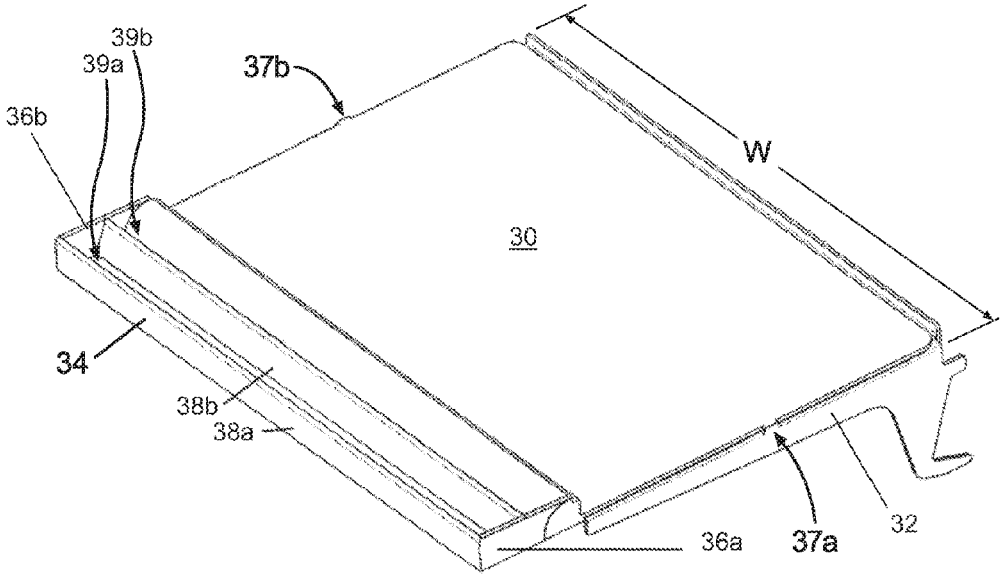
FIG. 2 is a perspective view of a shelf having a flow stabilizing device according to an embodiment of the invention.

FIG. 2 shows a flow stabilizing device 28 according to an embodiment of the invention which is fitted to one of the shelves 17 of the ORDC 2.

As shown in FIG. 2, each shelf 17 comprises a shelf portion 30 and a pair of brackets 32 which support the shelf portion 30 and are configured to be received within slots in the back panel 12 of the ORDC 2. A product information strip 34 extends across a front surface of the shelf portion 30 and has a channel for receiving tickets displaying information regarding the products on the shelf portion 30, such as the product's price.

The flow stabilizing device 28 comprises a pair of arms 36*a*, 36*b*. The arms 36*a*, 36*b* are affixed to either lateral side 37*a*, 37*b* of the shelf 17 such that they are spaced from one another across the width W of the shelf 17. Each of the arms 36*a*, 36*b* is connected at one end to the shelf 17 and extends away from the shelf 17 in a cantilevered manner to a free end. The arms 36*a*, 36*b* thus lie in the same plane as the shelf 17. The arms 36*a*, 36*b* may be connected to the shelf 17 in any suitable manner, such as via attachment to the shelf portion 30, the brackets 32 or the product information strip 34.

A pair of stabilizing beams 38*a*, 38*b* extend between the arms 36*a*, 36*b*. The stabilizing beams 38*a*, 38*b* are spaced from one another and run parallel to one another across the full width W of the shelf 17 (and the display area 15). The stabilizing beams 38*a*, 38*b* are arranged so that their widths extend in a vertical direction, substantially perpendicular to the shelf 17. The stabilizing beams 38*a*, 38*b* are, however, angled relative to one another so that the gap between the stabilizing beams 38*a*, 38*b* tapers toward the lower end of the stabilizing beams 38*a*, 38*b*. The stabilizing beams 38*a*, 38*b* thus define a first slot 39*a* having a vertical extent (length). The first slot 39*a* comprises an inlet 41 (see, e.g., FIG. 5) at an upper end and an outlet 43 (see, e.g., FIG. 5) at a lower end. The inlet 41 has a greater width than the outlet 43 and a convergent throat 45 (see, e.g., FIG. 5) is disposed between the inlet 41 and the outlet 43. The stabilizing beams 38*a*, 38*b* may taper at an angle of greater than 0° and less than 20° to the vertical. The angle may, however, differ between the two stabilizing beams 38*a*, 38*b* within a single flow stabilizing device 28. In particular, as shown, the outermost stabilizing beam 38*a* may be arranged vertically and the innermost stabilizing beam 38*b* angled relative to the outermost stabilizing beam 38*a*.

The outermost stabilizing beam 38*a* may be provided with a product information strip which can be used to display information regarding the products on the shelf portion 30 if the product information strip 34 of the shelf 17 itself is obscured by the stabilizing beams 38*a*, 38*b*. Alternatively, the stabilizing beams 38*a*, 38*b* may be transparent to allow the product information strip 34 of the shelf 17 to be viewed. This may also prevent the stabilizing beams 38*a*, 38*b* from blocking light from a light source within the ORDC 2 and thus ensure proper illumination of the products within the ORDC.

Figure 3:
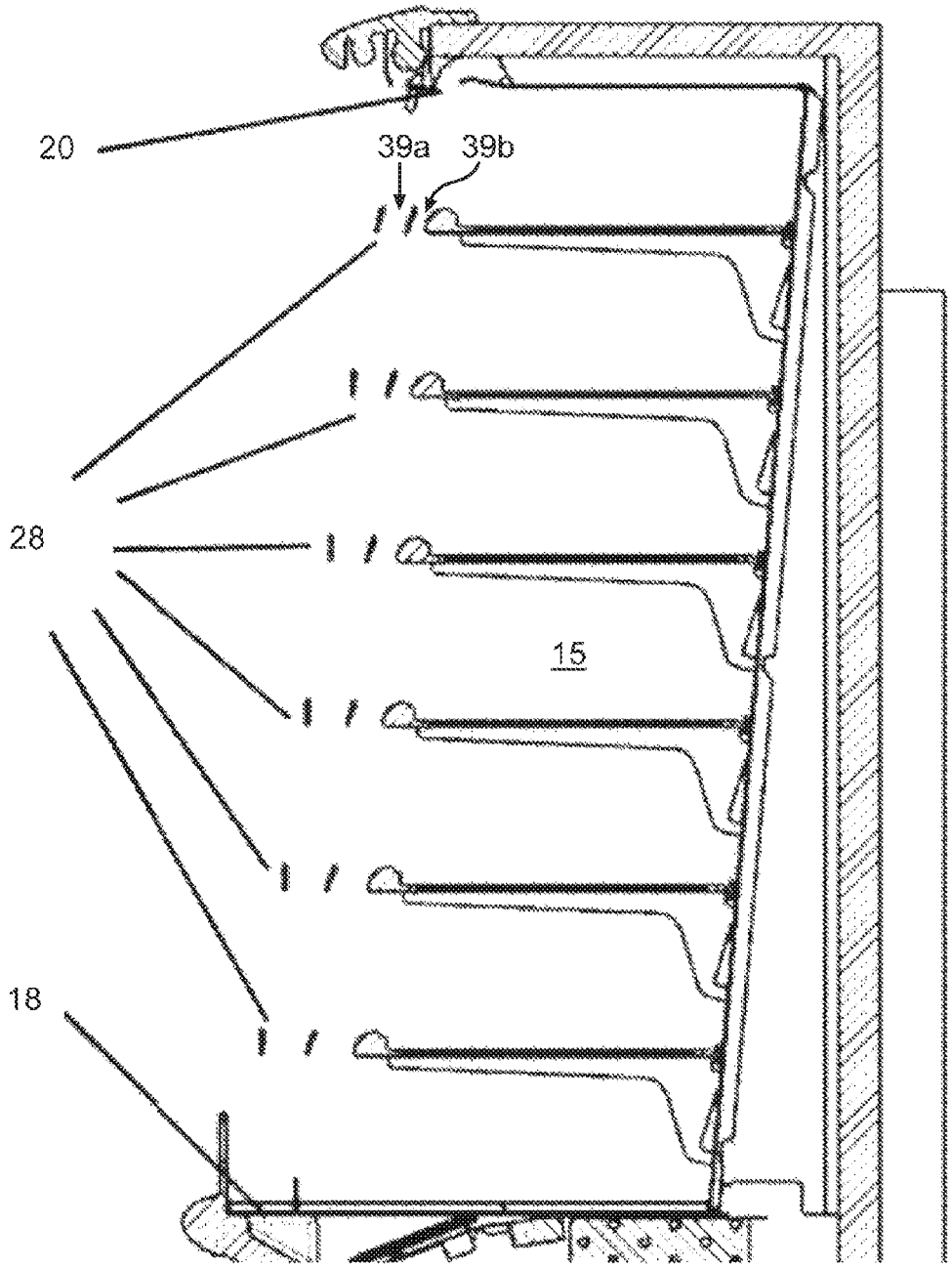
FIG. 3 is a side cross-section view of an ORDC according to an embodiment of the invention having a plurality of shelves with flow stabilizing devices as shown in FIG. 2.

As shown in FIG. 3, each of the shelves 17 is provided with a flow stabilizing device 28. The stabilizing beams 38*a*, 38*b* of each shelf 17 are spaced from the shelf 17 so as to form a second slot 39*b* between the innermost stabilizing beam 38*b* and the shelf 17. The stabilizing beams 38*a*, 38*b* are positioned such that the majority of the air curtain 26 passes between the stabilizing beams 38*a*, 38*b*, through the first slot 39*a*. A portion of the air curtain 26 may pass between the innermost stabilizing beam 38*b* and the shelf 17, through the second slot 39*b*, or beyond the exterior surface of the outermost stabilizing beam 38*a*. As described previously, the back panel 12 is perforated to allow air to pass from the duct 16 into the display area 15 where it cools items located on the shelves 17 and on the lower panel 10. The direction of air flow from the back panel 12 is thus predominantly perpendicular to that of the air curtain 26. The air from the back panel 12 is entrained with the portion of the air curtain 26 passing through the second slot 39*a* which turns the air flow towards the direction of the air curtain 26. This reduces the effect the air flow from the back panel 12 has on the air curtain 26.

As described previously, the air curtain 26 may be angled away from vertical and the stabilizing beams 38*a*, 38*b* may be spaced progressively further from the shelf 17 (or, where the shelves are of different lengths, from the back panel 12) from the uppermost shelf 17 to the lowermost shelf 17 so as to be aligned with the air curtain 26. The spacing between the stabilizing beams 38*a*, 38*b* may increase from the uppermost flow stabilizing device 28 to the lowermost flow stabilizing device 28 to account for the air curtain 26 becoming thicker as it passes down the front of the ORDC 2.

As described previously, the intake grille 18 is not directly aligned with the discharge grille 20. To counteract this, the stabilizing beams 38*a*, 38*b* of the uppermost flow stabilizing device 28 are curved so that the air curtain 26 is turned slightly as it passes through this flow stabilizing device 28. As shown, the stabilizing beams 38*a*, 38*b* of the uppermost flow stabilizing device 28 may also run parallel to one another such that they do not converge.

Figure 4:
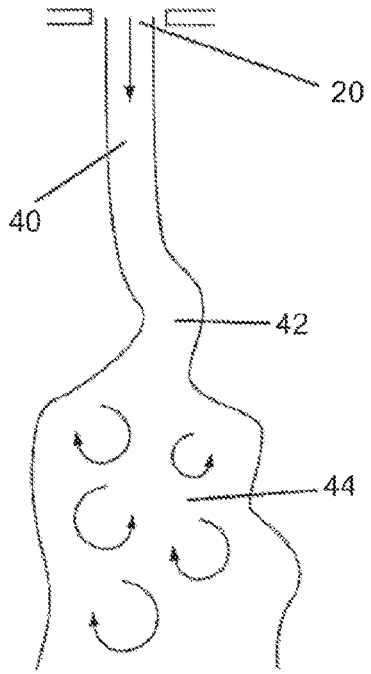
FIG. 4 (PRIOR ART)
FIG. 4 schematically shows air flow from the conventional ORDC of FIG. 1.
Figure 5:
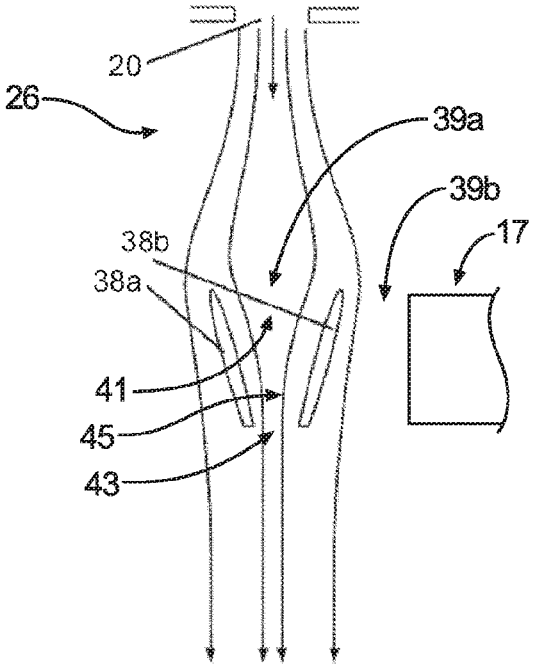
FIG. 5 schematically shows air flow from the ORDC of FIG. 3.

FIGS. 4 and 5 provide a comparison of the flow characteristics of the air curtain 26 without the flow stabilizing devices 28 of the invention (FIG. 4) and with the flow stabilizing devices 28 (FIG. 5).

As shown in FIG. 4, the air leaves the discharge grille 20 as a coherent jet 40. However, without the flow stabilizing devices 28, the jet 40 soon becomes unstable in region 42, and begins to separate. This causes a high level of turbulent mixing in region 44 which warms the air curtain 26 considerably, thus warming the ORDC 2.

As shown in FIG. 5, with the flow stabilizing devices 28 attached to the shelves 17, the air again exits the discharge grille 20, but before the air curtain 26 can become unstable the flow stabilizing device 28 acts to re-stabilize the flow. As described previously, the stabilizing beams 38*a*, 38*b* converge such that, as a result of the Venturi effect, the air is accelerated as it passes through the first slot 39*a* of the flow stabilizing device 28. The acceleration acts to further stabilize the air curtain 26. The width of the air curtain 26 is also reduced which helps maintain a thin shear layer throughout the length of the air curtain 26. The second slot 39*b* formed between the innermost stabilizing beam 38*b* and the shelf 17 further promotes stabilization of the air curtain 26 by drawing air from the back panel 12 into the air curtain 26.

The shelves 17 may be configured so as to allow the shelf portion 30 to be positioned at different angles. This may be beneficial for displaying different types of products. To allow for this, each flow stabilizing device 28 may be pivotably connected to the shelf 17 so that the flow stabilizing device 28 remains horizontal (or at some other predetermined orientation). For example, the arms 36*a*, 36*b* may be pivotably connected to the shelf 17. Alternatively, the arms 36*a*, 36*b* may each comprise first and second members connected to one another at an articulated joint. The arms 36*a*, 36*b* may also allow the distance of the stabilizing beams 38*a*, 38*b* from the shelf 17 to be varied. In particular, as the shelf 17 is angled away from horizontal, its horizontal extent will reduce so that the stabilizing beams 38*a*, 38*b* are located closer to the back panel 12. The arms 36*a*, 36*b* may therefore allow for this to be counteracted so that the stabilizing beams 38*a*, 38*b* remain in the correct position for the air curtain 26. For example, the arms 36*a*, 36*b* may allow the stabilizing beams 38*a*, 38*b* to be located in a plurality of positions (e.g. defined by discrete mounting holes or a continuous slot) or the arms 36*a*, 36*b* themselves may be connected to the shelf 17 in a plurality of positions. Alternatively, the arms 38*a*, 38*b* may comprise a telescoping arrangement to alter their length.

An initial study using Computational Fluid Dynamics has shown that the flow stabilizing device 28 of the invention could provide a reduction of around 40% in convective heat losses.

Although not shown, the flow stabilizing device 28 may comprise an injector port which receives additional air. For example, the injector port may be connected to the duct 16 via a conduit or the injector port may receive air which passes through the perforated back panel 12. The injector port may be located adjacent the inlet of the flow stabilizing device 28. The Venturi effect creates an area of low pressure within the flow stabilizing device 28 as the air curtain 26 is accelerated. This acts to draw in the additional air from the injector port which further increases the velocity of the air curtain, thus helping it to remain stable and intact in extreme ambient conditions.

The flow stabilizing devices 28 can be connected to a standard shelf 17 and thus allow the flow stabilizing devices 28 to be retrofit to existing ORDCs. The flow stabilizing devices 28 may, however, be integrally formed with the shelves 17 or the ORDC 2.

Although each shelf 17 of the ORDC 2 has been described as having a flow stabilizing device 28, this need not be the case and only some of the shelves 17 may be provided with flow stabilizing devices 28. It is, however, desirable that the flow stabilizing devices 28 are provided at regular spacings of between 120 mm and 190 mm, which corresponds to approximately 4 to 6 times the width of the discharge grille 20, and preferably at spacings of around 160 mm (5 times the width of the discharge grille 20).

Although the flow stabilizing devices 28 have been described as being connected directly to the shelves 17, they may instead be connected to other parts of the ORDC 2. For example, the arms 36*a*, 36*b* of the flow stabilizing devices 28 may connect to the back panel 12 such that the flow stabilizing devices 28 are positioned between adjacent shelves 17 (or between the lowermost shelf 17 and the lower panel 10). In particular, the flow stabilizing devices 28 may be positioned just below each of the shelves 17. Alternatively, the flow stabilizing devices 28 may be connected to the left and right side walls of the ORDC 2. In this case, the arms 36*a*, 36*b* can be omitted and the stabilizing beams 38*a*, 38*b* connected directly to the ORDC 2.

The stabilizing beams 38*a*, 38*b* also need not lie in the plane of the shelf 17. For example, the stabilizing beams 38*a*, 38*b* may be offset from the shelf 17 such that they are not aligned with the product information strip 34, thus allowing the product information strip 34 to be viewed. This may be achieved by using arms which are stepped or otherwise configured so that the connection to the shelf 17 and the connection to the stabilizing beams 38*a*, 38*b* are offset from one another.

In certain embodiments, the stabilizing beams 38*a*, 38*b* may not converge and are instead arranged parallel to one another. Such parallel stabilizing beams 38*a*, 38*b* may guide the air flow and prevent expansion of the air curtain, thus still re-stabilizing the flow.

The invention is not limited to the embodiments described herein, and may be modified or adapted without departing from the scope of the present invention.

The invention claimed is:

1. An open refrigerated display case comprising:

a refrigerated display area including one or more shelves;

an air outlet and an air inlet opening into the display area and spaced from one another;

a duct fluidically coupling the air inlet to the air outlet, wherein the duct is configured to direct air flow out of the air outlet across the display area and toward the air inlet to form an air curtain across the display area;

a flow stabilizing device provided with each of the one or more shelves, wherein each shelf of the one or more shelves includes a first lateral side and a second lateral side defining a shelf width extending therebetween, wherein each flow stabilizing device includes a pair of air flow stabilizing beams defining an innermost air flow stabilizing beam, and an outermost air flow stabilizing beam, wherein a first slot is formed between the innermost air flow stabilizing beam and the outermost air flow stabilizing beam, wherein the first slot extends across the display area for receiving the air curtain, wherein the first slot is defined by a stabilizing inlet, a stabilizing outlet and a stabilizing throat disposed therebetween, wherein the stabilizing throat converges from the stabilizing inlet to the stabilizing outlet, wherein a second slot is formed between the innermost air flow stabilizing beam and the shelf, wherein the stabilizing inlet of the first slot receives the air flow within the air curtain, wherein the stabilizing throat of the first slot is configured to stabilize the air flow within the air curtain, wherein the air flow within the air curtain exits the stabilizing outlet of the first slot, wherein each of the outermost air flow stabilizing beam and the innermost air flow stabilizing beam as well as the corresponding first slot and the second slot extend across the shelf width.

2. The open refrigerated display case as claimed in claim 1, wherein the stabilizing inlet is defined by a first dimension, wherein the stabilizing outlet is defined by a second dimension, wherein the first dimension is greater than the second dimension.

3. The open refrigerated display case as claimed in claim 1, wherein the stabilizing throat converges along the first slot at greater than 0° and less than 20°.

4. The open refrigerated display case as claimed in claim 1, wherein the flow stabilizing devices are spaced from the air outlet and/or one another by a distance which corresponds to approximately four-to-six times a depth of the air outlet.

5. The open refrigerated display case as claimed in claim 4, wherein the flow stabilizing devices are spaced by a distance which corresponds to approximately five times a width of the air outlet.

6. The open refrigerated display case as claimed in claim 1, wherein each flow stabilizing device is connected to the one or more shelves.

7. The open refrigerated display case as claimed in claim 1, wherein each flow stabilizing device is pivotably connected to the one or more shelves.

8. The open refrigerated display case as claimed in claim 1, wherein each flow stabilizing device is configured so as to allow a distance between the shelf and the stabilizing inlet of the first slot to be varied.

9. The open refrigerated display case as claimed in claim 1, wherein each flow stabilizing device further comprises a pair of arms that connect the innermost air flow stabilizing beam and the outermost air flow stabilizing beam to the open refrigerated display case.

10. The open refrigerated display case as claimed in claim 1, wherein the innermost air flow stabilizing beam and the outermost air flow stabilizing beam are transparent.

11. The open refrigerated display case as claimed in claim 1, wherein the outermost air flow stabilizing beam is provided with a product information strip.

12. The open refrigerated display case as claimed in claim 1, wherein the pair of air flow stabilizing beams are parallel to one another across the shelf width.

13. The open refrigerated display case as claimed in claim 1, wherein the pair of air flow stabilizing beams extend substantially perpendicularly with respect to an upper surface or a lower surface of each shelf.

14. The open refrigerated display case as claimed in claim 1, wherein the innermost air flow stabilizing beam and the outermost air flow stabilizing beam are arranged relative one another in an angled configuration such that the first slot formed therebetween tapers from the stabilizing inlet to the stabilizing outlet.

15. The open refrigerated display case as claimed in claim 1, wherein the outermost air flow stabilizing beam is arranged vertically with respect to an upper surface or a lower surface of each shelf, wherein the innermost air flow stabilizing beam is arranged at an angle relative to the outermost air flow stabilizing beam.

16. A flow stabilizing device for stabilizing an air curtain of an open refrigerated display case, the flow stabilizing device comprising:

a pair of air flow stabilizing beams defining an innermost air flow stabilizing beam and an outermost air flow stabilizing beam, wherein a first slot is formed between the innermost air flow stabilizing beam and the outermost air flow stabilizing beam, wherein the first slot is defined by a stabilizing inlet, a stabilizing outlet and a stabilizing throat disposed therebetween, wherein the stabilizing throat converges from the stabilizing inlet to the stabilizing outlet, wherein the flow stabilizing device is configured to be positioned so that a second slot is formed between the innermost air flow stabilizing beam and a shelf of the open refrigerated display case, wherein the shelf includes a first lateral side and a second lateral side defining a shelf width extending therebetween, wherein the stabilizing inlet of the first slot receives the air curtain, wherein the stabilizing throat of the first slot is configured to stabilize air flow within the air curtain, wherein the air flow within the air curtain exits the stabilizing outlet of the first slot, wherein each of the outermost air flow stabilizing beam and the innermost air flow stabilizing beam as well as the corresponding first slot and the second slot extend across the shelf width.

17. The flow stabilizing device as claimed in claim 16, wherein the stabilizing inlet is defined by a first dimension, wherein the stabilizing outlet is defined by a second dimension, wherein the first dimension is greater than the second dimension.

18. The flow stabilizing device as claimed in claim 17, wherein the stabilizing throat converges at greater than 0° and less than 20°.

19. The flow stabilizing device as claimed in claim 16, wherein the flow stabilizing device is configured to be pivotably connected to the shelf.

20. The flow stabilizing device as claimed in claim 16, wherein the flow stabilizing device is configured so as to allow a distance between the shelf and the stabilizing inlet of the first slot to be varied.

21. The flow stabilizing device as claimed in claim 16, wherein the flow stabilizing device further comprises:

a pair of arms that are configured to connect the pair of air flow stabilizing beams to the open refrigerated display case.

22. The flow stabilizing device as claimed in claim 16, wherein the pair of air flow stabilizing beams are transparent.

23. The flow stabilizing device as claimed in claim 16, wherein the outermost air flow stabilizing beam is provided with a product information strip.

24. The flow stabilizing device as claimed in claim 16, wherein the pair of air flow stabilizing beams are parallel to one another across the shelf width.

25. The flow stabilizing device as claimed in claim 16, wherein the pair of air flow stabilizing beams extend substantially perpendicularly with respect to an upper surface or a lower surface of each shelf.

26. The flow stabilizing device as claimed in claim 16, wherein the innermost air flow stabilizing beam and the outermost air flow stabilizing beam are arranged relative one another in an angled configuration such that the first slot formed therebetween tapers from the stabilizing inlet to the stabilizing outlet.

27. The flow stabilizing device as claimed in claim 16, wherein the outermost air flow stabilizing beam is arranged vertically with respect to an upper surface or a lower surface of each shelf, wherein the innermost air flow stabilizing beam is arranged at an angle relative to the outermost air flow stabilizing beam.

* * * * *